United States Patent [19]

Garfinkle

[11] Patent Number: 4,591,057

[45] Date of Patent: May 27, 1986

[54] DELI TAG MOLDING

[75] Inventor: Benjamin L. Garfinkle, Alameda, Calif.

[73] Assignee: Clamp Swing Pricing Co., Alameda, Calif.

[21] Appl. No.: 738,054

[22] Filed: May 24, 1985

Related U.S. Application Data

[63] Continuation of Ser. No. 248,491, Mar. 27, 1981, abandoned.

[51] Int. Cl.[4] ..... A47F 5/08

[52] U.S. Cl. ..... 211/59.1; 211/106; 248/220.2; 248/220.4

[58] Field of Search ..... 211/54.1, 57.1, 70.6, 211/106, 59.1, 87; 248/220.2, 220.3, 220.4, 221.1, 221.2

[56] References Cited

U.S. PATENT DOCUMENTS

| | | | |
|---|---|---|---|
| 1,306,297 | 6/1919 | Auerochs | 211/59.1 |
| 2,802,576 | 6/1955 | Kelling | 211/59.1 |
| 3,486,632 | 12/1969 | Balch | 211/57.1 |
| 3,610,425 | 10/1971 | Madey | 248/220.3 |
| 3,976,201 | 8/1976 | Hodgson et al. | 248/220.4 X |
| 3,986,613 | 10/1976 | Mayer | 211/57.1 |
| 4,007,841 | 2/1977 | Seipel | 211/59.1 |
| 4,319,731 | 3/1982 | Pfeifer | 248/220.4 |

*Primary Examiner*—Robert W. Gibson, Jr.
*Attorney, Agent, or Firm*—Malcolm B. Wittenberg

[57] ABSTRACT

An article support and display assembly is disclosed wherein a common peg bar is used to accept molding support pegs and merchandise pegs which are readily removable from the peg bar and which are thus adjustable so that the tag molding can be located above and forward of merchandise being supported by the merchandise pegs.

1 Claim, 4 Drawing Figures

DELI TAG MOLDING

This is a continuation of application Ser. No. 248,491, filed Mar. 27, 1981, now abandoned.

BACKGROUND OF THE INVENTION

The invention relates to an article support and display apparatus for supporting articles of merchandise in display racks or cases and the like. Such displays are utilized in grocery stores, supermarkets and typically include a base support member or panel having apertures therein in which are inserted hanger rods and the articles of manufacture are suspended from said rods. One such display case used in displaying refrigerated foods such as meats and cheeses includes an elongated angle iron with the flanges thereof diverging upward, one flange having a circular opening therethru and the other flange having a semi-circular slot therein positioned for receiving the cylindrical hanger rod. Springclips are applied to the rod on the back side of the flange containing the circular aperture for preventing the rod from being pulled out of the angle iron. Such a configuration is shown in U.S. Pat. No. 4,007,841.

A cursory review of the prior art clearly shows that there is a marked lack in uniformity between the various merchandise support and display assemblies currently available. Thus, one having a support bracket of one manufacturer could not use hanger rods of another manufacturer. There is, thus, a distinct need in this industry for support and display assemblies whereby molding support pegs and merchandise pegs could be used in virtually any standard peg bar.

Display racks of a type having forwardly projecting article supporting rods are known which are adapted to be mounted on a vertical wall or support plate for use in open front refrigerator display cases as used in supermarkets and the like. For example, display racks of this type are disclosed in U.S. Pat. No. 3,486,632. Commonly displayed are two sets of supporting rods, one for the merchandise to be sold and the second to support the molding which displays various pricing and informational tags associated with the merchandise. Ideally, the tag molding should be placed directly over and slightly behind the end of the merchandise support peg, so that a supermarket customer can readily identify the product being sold and its pricing information. Unfortunately, prior art display devices have not always been able to provide this convenience.

FIG. 1 shows a tag molding assembly 10 comprising molding support pegs 2, 3 which are actually a single U-shaped supporting rod fixedly attached to tag molding 1. The support rods are configured to possess "S" shaped segments 4, 5 which cause the tag molding 1 to locate above merchandise support rod (not shown). Distal ends 6, 7 of molding support pegs 2, 3 are adapted to fit into ordinary peg bar supports.

Although the molding display shown in FIG. 1 does offer some flexibility by providing for a channel 30 within tag molding 1 so that pricing and other merchandise information can slide within said channel to locate proximate to the merchandise being displayed, the use of such a configuration offers serious problems. For example, a molding display must be fabricated to align with holes in the peg bar support which are spaced a specific distance from one another to receive distal ends 6, 7. With such a rigid frame, a store operator cannot always locate his product as he would like. By having to set up merchandise pegs around the molding pegs, it has been found that the user must forfeit about one product space per 4 foot section of display, resulting in a display loss of about 12%.

It is thus an object of the present invention to provide an article support and display assembly without the drawbacks of the prior art.

It is a further object of the present invention to provide an article support and display assembly adaptable for use with any conventional peg bar support.

It is still another object of the present invention to provide an article support and display assembly whereby both the molding support pegs and merchandise pegs are readily removable and interchangeable to allow for enhanced ease in the display and pricing of merchandies.

These and further objects of the present invention will be more fully appreciated when considering the following in view of the appended figures wherein.

DETAILED DESCRIPTION OF THE INVENTION

Figure 1:
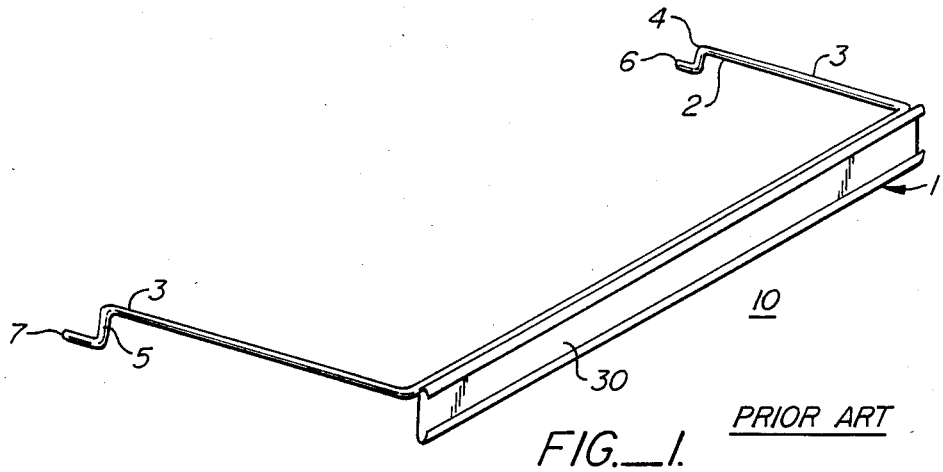
FIG. 1. PRIOR ART
Figure 2:
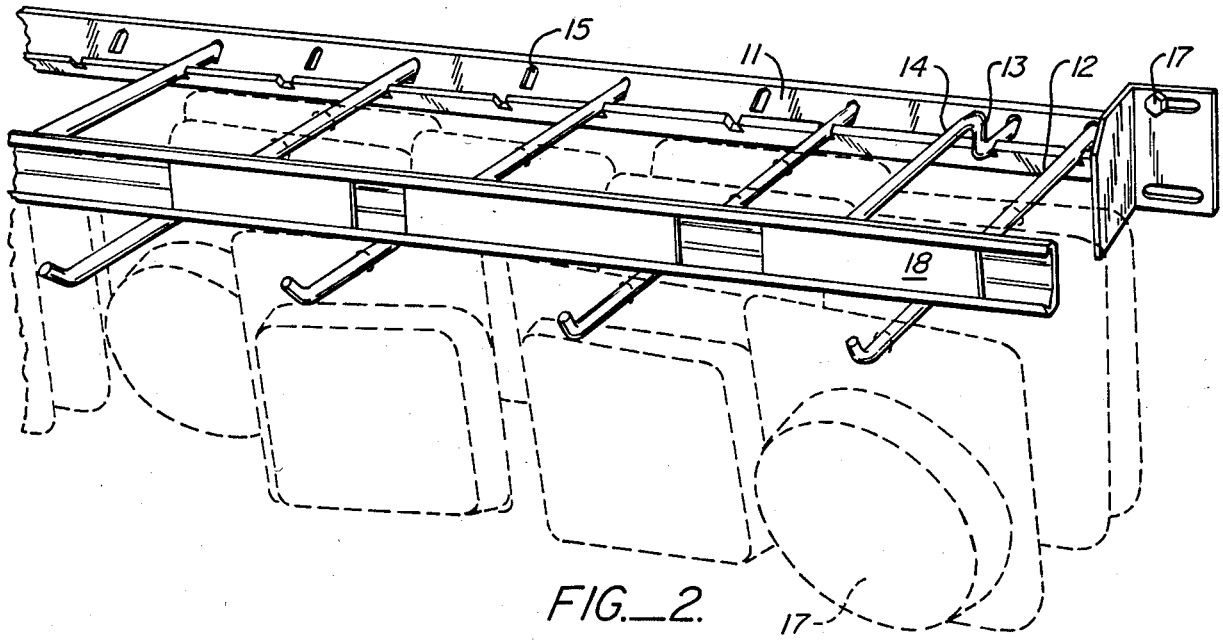
FIG. 2 shows the article support and display assembly of the prior art in plane view.
Figure 3:
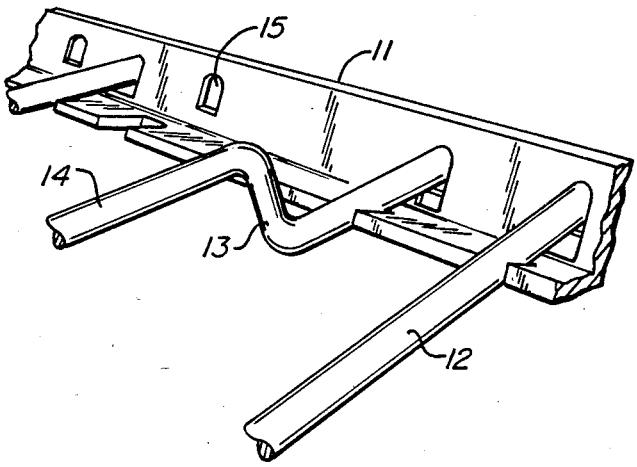
FIG. 3 depicts a detailed perspective of a prior art peg bar supporting a molding support peg and merchandise peg of the present invention.
Figure 4:
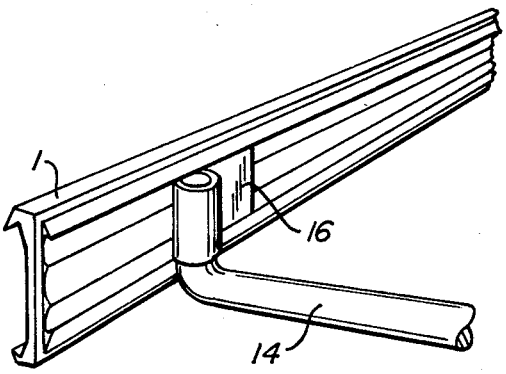
FIG. 4 is a detailed perspective view of the rear side of a segmented tag molding being connected to the molding support peg of the present invention.

Referring now to the drawings in more detail, FIG. 2 depicts a plane view of the present invention whereby a standard peg bar support 11 is shown fixedly attached to a supporting wall via right angle bracket 17, the matching right angle bracket not being shown. Although the peg bar is shown as a base support angle iron such as that shown in U.S. Pat. No. 4,007,841, any standard peg bar support may be used having means for receiving various supporting rods.

The supporting rods 12 and 14 basically are of two types, one for supporting merchandise and a second for supporting molding. Merchandise peg 12 basically comprises a straight rod having a substantially circular cross-section and a slight upward bend at its distal end. It is noted, however, that virtually any of the prior art merchandise support pegs can be used in practicing the present invention.

The molding support 14 is configured with a substantially "S" section to raise the distal end of the rod above the vertical plane of that section which is inserted within slot 15. In this way, the molding attached to the distal end of rod 14 is situated above merchandise 17 being suspended from merchandise peg 12.

The tag molding 1 is attached to molding support peg 14 via molding clip 16. The molding clip fits directly into the backtrack of the tag molding and can slide along the track to finally position the molding support to align with a receiving position of the peg bar support. This allows the tag molding section, (usually supplied in lengths equal to the peg bar support), to be placed in proper alignment with said bar, so that pricing information tags 18 can be situated directly above merchandise 17.

One of the prime advantages in practicing the present invention is the flexibility offered the user in the ability to now vary the position and length of the merchandise and molding support pegs. For example, these pegs generally come in 8, 10, 12 and 15 inch lengths. If a user opens a display with 8 inch pegs and then changes to 12 inch, the prior art rigid frame molding that was built for an 8 inch extension would no longer be visible to the consumer, having been buried by the product in a 12 inch display. With the present invention, the store operator need merely replace his 8 inch molding support pegs with a pair of 12 inch pegs. Furthermore, it may be desirable to limit the width of a piece of tag molding to appear only above certain products in the display case. With the rigid tag molding of the prior art, there would be no way to conform the existing molding to a shorter, more limited configuration. With the present invention, a shorter segment of molding can simply be attached to a pair of molding support pegs in virtually any width as desired.

While for purposes of illustration, certain structural details envisioned by the present invention have been disclosed herein, it should be understood that said invention is limited only by the scope of the appended claims.

What is claimed is:

1. An article support and display assembly comprising:

A. a longitudinally extending peg bar having means proximate its distal ends for supporting said peg bar to securely fix it in place;

B. means located along said peg bar for receiving molding support pegs and merchandise pegs;

C. at least one rod-like merchandise peg, said merchandise peg being adapted to be received by said peg bar;

D. a price tag display device having at least two slidable molding clips and a price tag molding comprising a forward track and a rearward track, said forward track being adapted to slidably receive at least one price tag and said rearward track being adapted to slidably receive at least two of said molding clips; and E. at least one molding support peg, characterized as having a forward end and a rearward end, wherein said rearward end has a nonlinear extension that is adapted to be received by said peg bar so as to position said price tag display device above said merchandise peg while said forward end is adapted to be received by one of said molding clips, thereby defining a price tag display device that is adjustable relative to said merchandise peg independent of the position of said merchandise peg along said entire longitudinal length of said peg bar utilizing said two nonlinear extensions of said molding support pegs, and is slidably positionable relative to said merchandise peg independent of the position of said merchandise peg utilizing said slidable price tag molding and two of said molding clips.

* * * * *